US009318039B2

(12) United States Patent
Park et al.

(10) Patent No.: US 9,318,039 B2
(45) Date of Patent: Apr. 19, 2016

(54) METHOD OF OPERATING AN ORGANIC LIGHT EMITTING DISPLAY DEVICE, AND ORGANIC LIGHT EMITTING DISPLAY DEVICE

(71) Applicant: Samsung Display Co., LTD., Yongin, Gyeonggi-Do (KR)

(72) Inventors: Ji-Eun Park, Suwon-si (KR); Dong-Won Lee, Yongin-si (KR); Eun-Gyeong Choe, Suwon-si (KR); Hee-Chul Hwang, Suwon-si (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 0 days.

(21) Appl. No.: 14/290,794

(22) Filed: May 29, 2014

(65) Prior Publication Data

US 2015/0235588 A1 Aug. 20, 2015

(30) Foreign Application Priority Data

Feb. 14, 2014 (KR) ..... 10-2014-0017051

(51) Int. Cl.
*G09G 3/32* (2006.01)
*G09G 3/20* (2006.01)

(52) U.S. Cl.
CPC ..... *G09G 3/2003* (2013.01); *G09G 3/3208* (2013.01); *G09G 2320/0242* (2013.01); *G09G 2320/0271* (2013.01)

(58) Field of Classification Search
None
See application file for complete search history.

(56) References Cited

U.S. PATENT DOCUMENTS

| | | | | |
|---|---|---|---|---|
| 2005/0083263 | A1 | 4/2005 | Park | |
| 2006/0001607 | A1* | 1/2006 | Song et al. | 345/63 |
| 2006/0214886 | A1 | 9/2006 | Takeuchi et al. | |
| 2007/0024609 | A1* | 2/2007 | Lee et al. | 345/208 |
| 2008/0170159 | A1 | 7/2008 | Akiyama et al. | |
| 2009/0267962 | A1* | 10/2009 | Kim et al. | 345/596 |

FOREIGN PATENT DOCUMENTS

| | | | |
|---|---|---|---|
| KR | 10-2005-0036606 | A | 4/2005 |
| KR | 10-2005-0100450 | A | 10/2005 |
| KR | 10-2006-0103853 | A | 10/2006 |
| KR | 10-2007-0110754 | A | 11/2007 |
| KR | 10-2008-0041109 | A | 5/2008 |

* cited by examiner

*Primary Examiner* — David D Davis
(74) *Attorney, Agent, or Firm* — Knobbe, Martens, Olson & Bear, LLP

(57) ABSTRACT

A method of operating an organic light emitting diode (OLED) display device and an OLED display using the method are disclosed. In one aspect, input data is received, the input data is converted into mapped data based on random data mapping information, one sub-frame pattern is selected from a plurality of sub-frame patterns based on the random data mapping information, and an image is formed for the display device based on the mapped data and the selected sub-frame pattern.

20 Claims, 8 Drawing Sheets

FIG. 4

| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| PATTERN1 | 1 | 2 | 4 | 7 | 12 | 20 | 32 | 48 | 66 | 90 | 102 | 127 |
| PATTERN2 | 1 | 2 | 4 | 7 | 15 | 24 | 32 | 40 | 66 | 91 | 104 | 125 |
| ⋮ | ⋮ | | | | | | | | | | | |

METHOD OF OPERATING AN ORGANIC LIGHT EMITTING DISPLAY DEVICE, AND ORGANIC LIGHT EMITTING DISPLAY DEVICE

CROSS-REFERENCE TO RELATED APPLICATIONS

This application claims priority under 35 U.S.C. §119 to Korean Patent Application No. 10-2014-0017051 filed on Feb. 14, 2014, the disclosure of which is hereby incorporated by reference in its entirety.

BACKGROUND

1. Field

The described technology generally relates to display devices; particularly, to the organic light emitting display devices and to methods of operating those display devices.

2. Description of the Related Technology

An active matrix organic light emitting display device can be driven with analog or digital driving method. While the analog driving method produces grayscale using variable voltage levels corresponding to input data, the digital driving method produces grayscale using variable time duration in which an organic light emitting diode emits light. The analog driving method is difficult to implement because it requires a driving integrated circuit (IC) that is complicated to manufacture if the display is to have a large size and high resolution. The digital driving method, on the other hand, can readily accomplish the required high resolution through a simpler IC structure. Also, the digital driving method uses on and off states of a driving thin film transistor (TFT) which is seldom influenced by image quality deterioration due to TFT characteristics deviation. Therefore, digital driving methods are useful for a large panel display.

However, with digital driving, since pixels do not continuously emit light during one frame, and repeat the light emission and non-emission, a dynamic false contour, that does not exist in a real image, can occur as a viewer scans across a moving image.

SUMMARY OF CERTAIN INVENTIVE ASPECTS

Inventive aspects relate to a method of operating an organic light emitting display device. In the method, input data is received, the input data is converted into mapped data based on random data mapping information, a sub-frame pattern is selected from a plurality of sub-frame patterns based on the random data mapping information, and an image is displayed based on the mapped data by using the selected sub-frame pattern.

In some embodiments, the plurality of sub-frame patterns may have different gray levels at which dynamic false contours occur.

In some embodiments, luminances of a plurality of pixels included in the organic light emitting display device may be measured at a maximum gray level, and the random data mapping information may be generated based on the measured luminances of the plurality of pixels such that the plurality of pixels have substantially a same luminance when displaying a white image.

In some embodiments, the sub-frame pattern may be selected according to a sub-frame pattern selection information stored in the organic light emitting display device.

In some embodiments, the sub-frame pattern selection information may be generated based on a white image gray level distribution determined by the random data mapping information.

In some embodiments, the sub-frame pattern selection information may be generated based on a middle value or an average value of the white image gray level distribution.

In some embodiments, selecting the sub-frame pattern may be performed at each frame.

In some embodiments, to select the sub-frame pattern from the plurality of sub-frame patterns, a gray level distribution of the mapped data may be identified at each frame, and the sub-frame pattern may be selected from the plurality of sub-frame patterns based on the gray level distribution of the mapped data.

In some embodiments, the sub-frame pattern may be selected based on a middle value or an average value of the gray level distribution of the mapped data.

In another aspect, an organic light emitting display device is provided. The organic light emitting display device includes a display unit including a plurality of pixels, and a driving unit configured to receive an input data, to convert the input data into mapped data based on a random data mapping information, to select a sub-frame pattern from a plurality of sub-frame patterns based on the random data mapping information, and to control the display unit to display an image based on the mapped data by using the selected sub-frame pattern.

In some embodiments, the plurality of sub-frame patterns may have different gray levels at which dynamic false contours occur.

In some embodiments, luminances of a plurality of pixels included in the organic light emitting display device may be measured at a maximum gray level, and the random data mapping information may be generated based on the measured luminances of the plurality of pixels such that the plurality of pixels have substantially a same luminance when displaying a white image.

In some embodiments, the driving unit may include a random data mapping information storing unit configured to store the random data mapping information, a sub-frame pattern storing unit configured to store the plurality of sub-frame patterns, and a selection information storing unit configured to store sub-frame pattern selection information indicating the sub-frame pattern selected from the plurality of sub-frame patterns.

In some embodiments, the driving unit may be configured to drive the display unit by using the sub-frame pattern indicated by the sub-frame pattern selection information stored in the selection information storing unit.

In some embodiments, the sub-frame pattern selection information may be generated based on a white image gray level distribution determined by the random data mapping information.

In some embodiments, the sub-frame pattern selection information may be generated based on a middle value or an average value of the white image gray level distribution.

In some embodiments, the driving unit may include a random data mapping information storing unit configured to store the random data mapping information, a sub-frame pattern storing unit configured to store the plurality of sub-frame patterns, and a sub-frame pattern selecting unit configured to select the sub-frame pattern from the plurality of sub-frame patterns.

In some embodiments, the sub-frame pattern selecting unit may select the sub-frame pattern at each frame.

In some embodiments, the sub-frame pattern selecting unit may identify a gray level distribution of the mapped data at each frame, and may select the sub-frame pattern from the plurality of sub-frame patterns based on the gray level distribution of the mapped data.

In some embodiments, the sub-frame pattern selecting unit may calculate a middle value or an average value of the gray level of the mapped data, and selects the sub-frame pattern from the plurality of sub-frame patterns based on the calculated middle value or the calculated average value.

BRIEF DESCRIPTION OF THE DRAWINGS

These drawings and the associated description herein are provided to illustrate specific embodiments of the invention and are not intended to be limiting.

FIG. 4 is a diagram illustrating an example of sub-frame patterns stored in a sub-frame pattern storing unit illustrated in FIG. 2.

DETAILED DESCRIPTION OF CERTAIN INVENTIVE EMBODIMENTS

Example embodiments will now be described more fully hereinafter with reference to the accompanying drawings. However, the described embodiments may be embodied in different forms and should not be construed as limited to the embodiments set forth herein. Rather, these embodiments are provided so that this disclosure will be thorough and complete and will fully convey the scope of the described technology to those skilled in the art.

Figure 1:
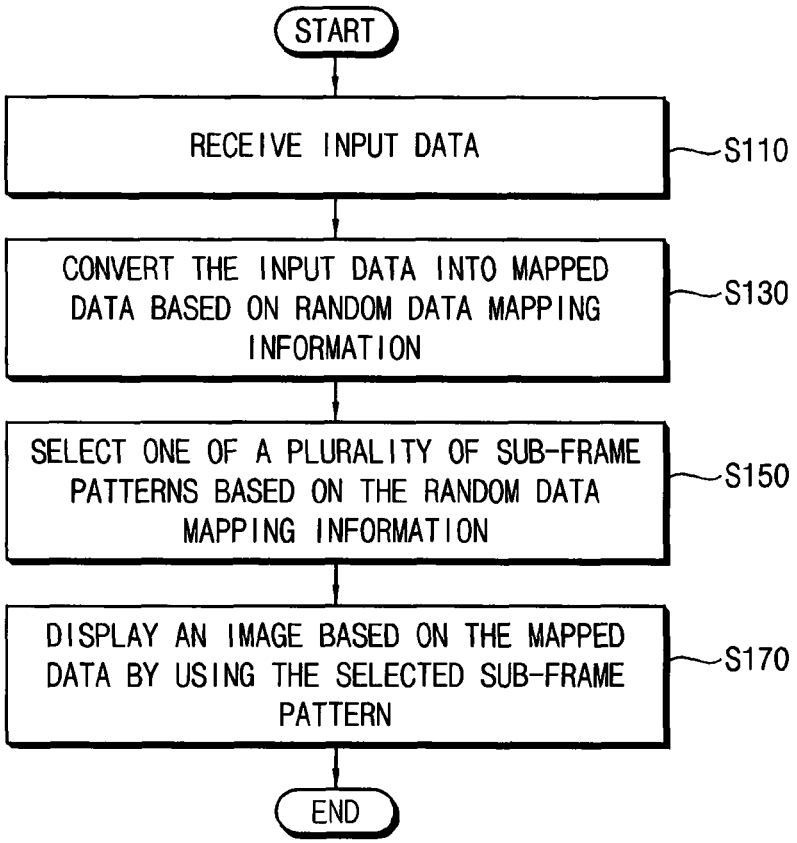
FIG. 1 is a flowchart illustrating a method of operating an organic light emitting display device in accordance with example embodiments.

FIG. 1 is a flowchart illustrating a method of operating an organic light emitting display device in accordance with example embodiments.

An organic light emitting display device according to example embodiments may represent grayscale with a variable time duration for which an organic light emitting diode included in each pixel emits light while pixels receive data voltages having substantially the same voltage level. In some example embodiments, unlike a conventional digital driving method where a driving transistor of each pixel operates in a linear region, the organic light emitting display device may be driven with a hybrid digital driving method where a driving transistor of each pixel operates in a saturated region.

Referring to FIG. 1, in the digital or hybrid digital method of driving the organic light emitting display device, the organic light emitting display device is configured to receive input data at each frame (S110), and convert the input data into mapped data based on random data mapping information (S130). Since in the digital or the hybrid digital driving method, the driving transistor of each pixel operates in the saturated region, luminance deviations may exist between different pixels included in an organic light emitting display device. However, in the hybrid digital driving method, the input data may be converted into the mapped data based on the random data mapping information such that luminances of the pixels are substantially the same as each other for the same gray level of the input data. In some example embodiments, luminances of a plurality of pixels included in the organic light emitting display device may be measured at the maximum gray level, and the random data mapping information may be generated based on the measured luminances of the plurality of pixels such that the plurality of pixels have substantially the same luminance when displaying a white image (or a full-white image).

The random data mapping information generated based on the measured luminances may be unique to the organic light emitting display device. Differences between luminances of pixels and a reference pixel luminance may be calculated based on the measured luminances of the pixels at the maximum gray level. Then, compensation ratios of the input data for the pixels may be determined based on the calculated differences. The random data mapping information may include the compensation ratios. The input data may be converted into the mapped data according to the compensation ratios of the random data mapping information. Accordingly, the organic light emitting display device may adjust time durations for which the pixels emit light based on the mapped data instead of the input data. Thus the pixels may emit light having substantially the same luminance at the same gray level of the input data even if the luminance deviations exist between the pixels.

The organic light emitting display device selects one sub-frame pattern from a plurality of sub-frame patterns that are different from each other based on the random data mapping information (S150). The plurality of sub-frame patterns may be different from each other in at least one of the following characteristics: the number of sub-frames, lengths of sub-frames, order of sub-frames, etc. Accordingly, the plurality of sub-frame patterns may have different gray levels at which dynamic false contours occur. That is, when different sub-frame patterns of the plurality of sub-frame patterns are used, dynamic false contours may occur at different gray levels.

In some example embodiments, a sub-frame pattern may be selected according to sub-frame pattern selection information stored in the organic light emitting display device. The sub-frame pattern selection information may be generated based on a white image gray level distribution determined by the random data mapping information. Here, the white image gray level distribution may mean a distribution of gray levels represented by the pixels when the organic light emitting display device displays a white image.

The sub-frame pattern selection information may be generated based on a middle value or an average value of the white image gray level distribution. That is, a sub-frame pattern from the plurality of sub-frame patterns may be selected such that the selected sub-frame pattern has no gray level or has less gray level than the gray level at which dynamic false contour occurs, as observed near the middle value or the average value of the white image gray level distribution. Subsequently, the organic light emitting display device may display an image using the selected sub-frame pattern indicated by the sub-frame pattern selection information, which results in the reduction of dynamic false contours at the displayed image (in particular, when displaying a white image).

In the hybrid digital driving method, dynamic false contour may occur more frequently when displaying a white image (or a full-white image) than a normal image or a non-white image. Further, since white color is more frequently used in recent display devices, for example, in a web page or a background screen, dynamic false contour may be more problematic in a recent display device driven with a hybrid digital driving method. In the organic light emitting display device according to example embodiments, the sub-frame pattern is selected based on the white image gray level distribution determined by the random data mapping information, and thus the occurrence of dynamic false contours may be reduced when displaying a white image. This results in an improvement of the image quality.

In some example embodiments, the sub-frame pattern selection information may be generated before the normal operation of the organic light emitting display device, for example, when the organic light emitting display device is manufactured. The sub-frame pattern selection information may be generated by an external test device, and written into the organic light emitting display device.

In other example embodiments, a sub-frame pattern may be selected at each frame based on a gray level distribution of the mapped data determined by the input data of the frame and the random data mapping information. That is, at each frame, the gray level distribution of the mapped data of the frame may be identified, and a sub-frame pattern from among multiple sub-frame patterns may be selected based on the identified gray level distribution of the mapped data. For example, a sub-frame pattern may be selected according to a middle value or an average value of the gray level distribution of the mapped data. That is, a sub-frame pattern from the multiple sub-frame patterns may be selected such that the selected sub-frame pattern has no gray level or has less gray level than the gray level at which dynamic false contour occurs, as observed near the middle value or the average value of the gray level distribution of the mapped data. Subsequently, the organic light emitting display device may display an image using the selected sub-frame pattern, which results in the reduction of dynamic false contours at the displayed image. As described above, in some example embodiments, the sub-frame pattern to be used may be selected per frame, thereby, further improving the image quality of the organic light emitting display device.

The organic light emitting display device displays an image based on the mapped data by using the selected sub-frame pattern (S170). Thus, each pixel included in the organic light emitting display device may represent a gray level indicated by the mapped data instead of a gray level indicated by the input data. That is, each pixel may emit light during a period corresponding to the gray level indicated by the mapped data. Further, to represent the gray level indicated by the mapped data, each pixel may selectively emit or not emit light according to the mapped data of the sub-frames included in the selected sub-frame patterns.

As described above, in the method of operating the organic light emitting display device according to the example embodiments, the organic light emitting display device may select one sub-frame pattern among a plurality of sub-frame patterns based on the random data mapping information that may be unique to an organic light emitting display device. Thus each organic light emitting display device may use the sub-frame pattern that is suitable for that organic light emitting display device. Since a suitable sub-frame pattern is used for each organic light emitting display device, dynamic false contour may be reduced, and the image quality may improve.

Figure 2:
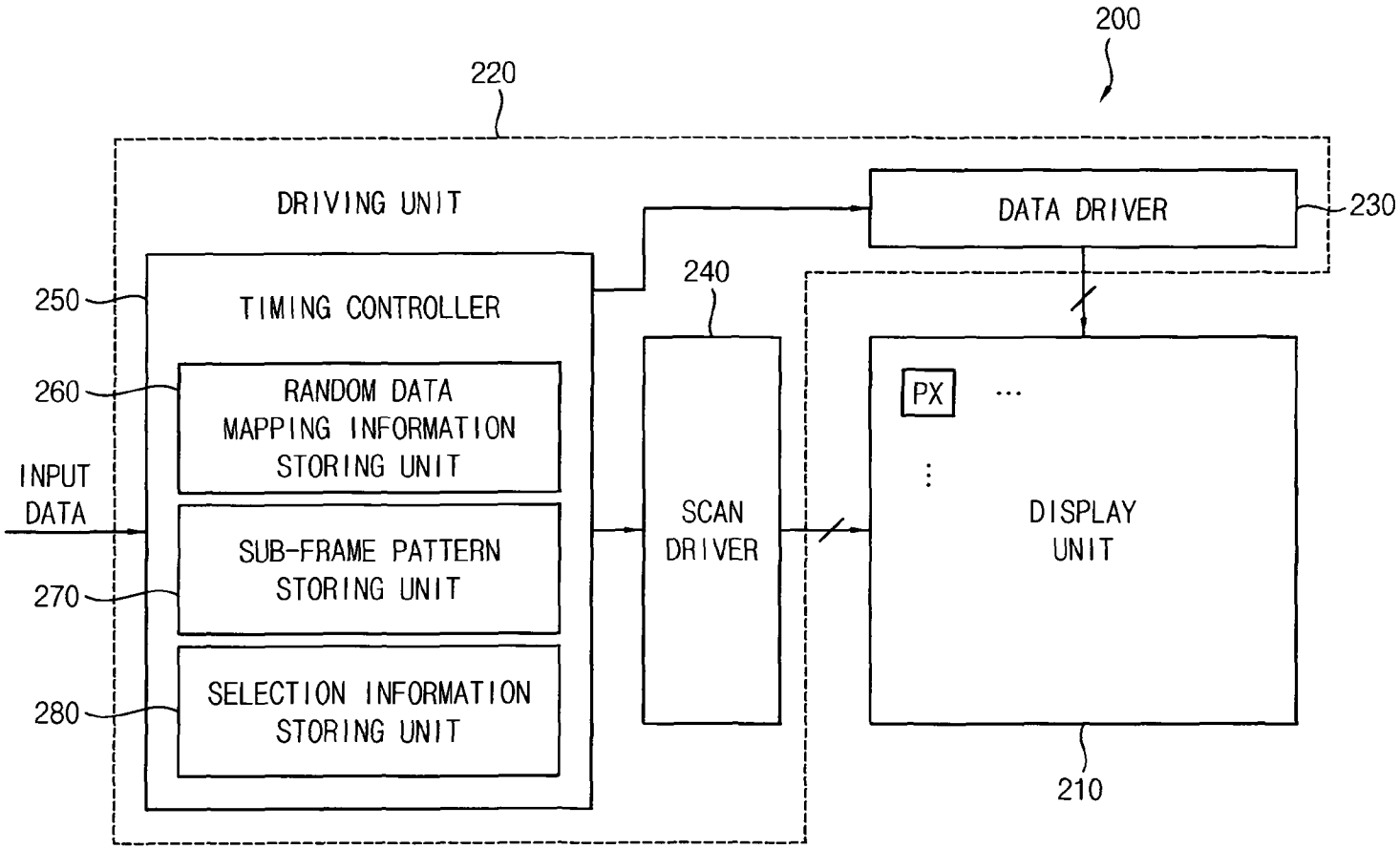
FIG. 2 is a block diagram illustrating an organic light emitting display device in accordance with example embodiments.
Figure 3:
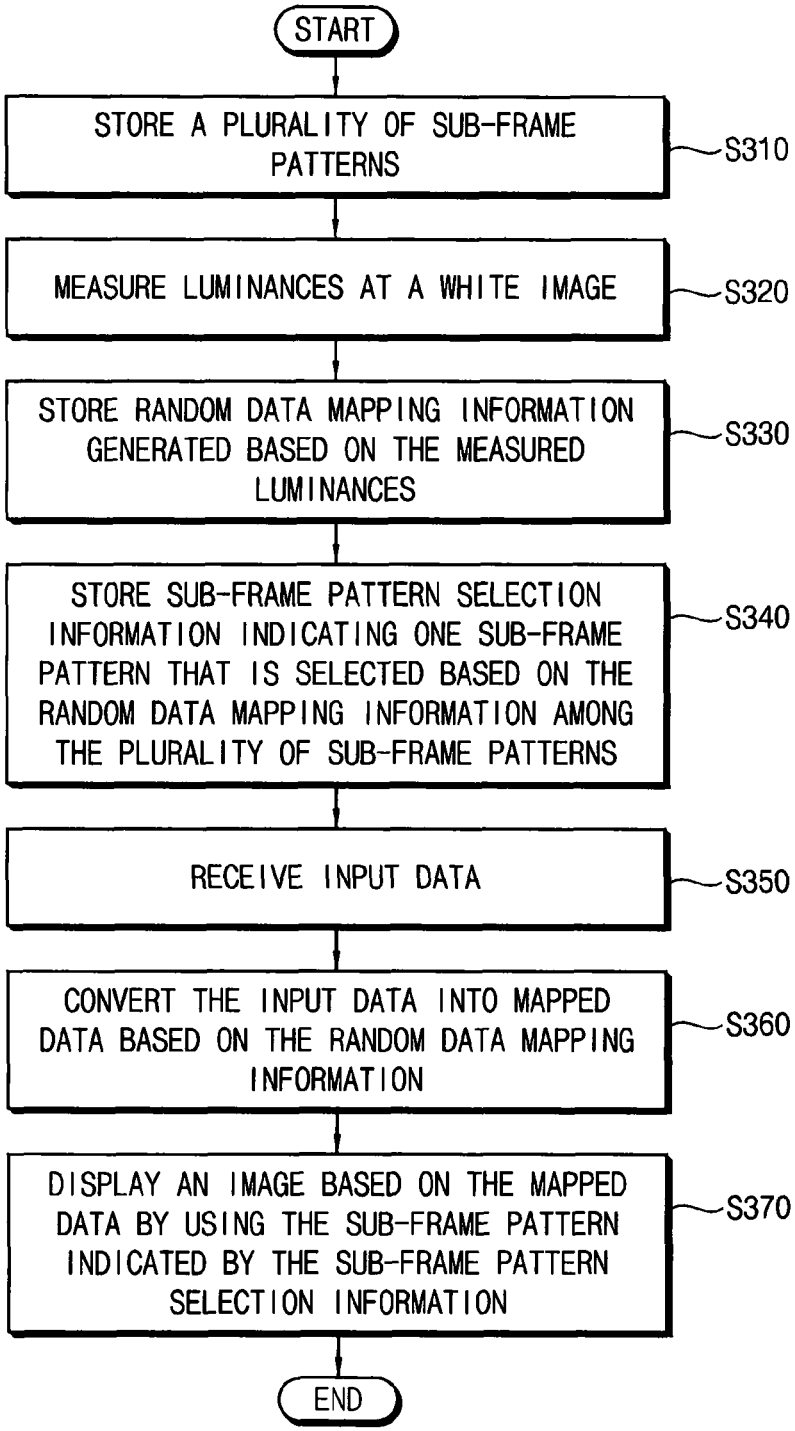
FIG. 3 is a flowchart illustrating a method of operating an organic light emitting display device in accordance with example embodiments.
Figure 5:
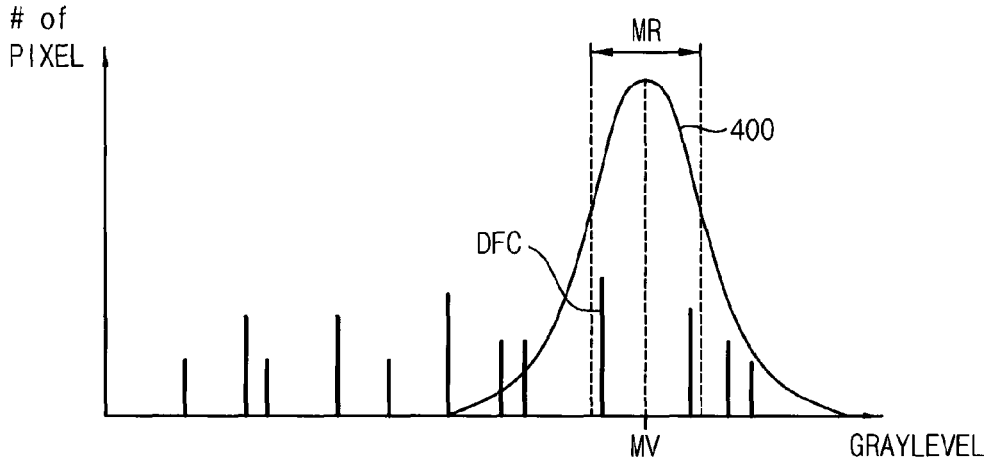
FIG. 5 is a diagram illustrating an example of a white image gray level distribution and an example of gray levels at which dynamic false contours occur when one of sub-frame patterns illustrated in FIG. 4 is used.
Figure 6:
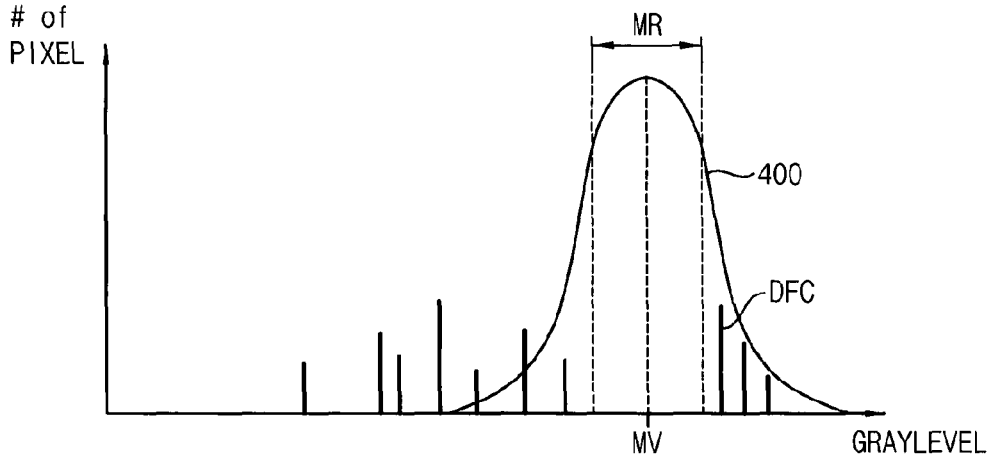
FIG. 6 is a diagram illustrating an example of a white image gray level distribution and an example of gray levels at which dynamic false contours occur when another one of sub-frame patterns illustrated in FIG. 4 is used.

FIG. 2 is a block diagram illustrating an organic light emitting display device in accordance with example embodiments. FIG. 3 is a diagram illustrating a method of operating an organic light emitting display device in accordance with example embodiments. FIG. 4 is a diagram illustrating an example of sub-frame patterns stored in a sub-frame pattern storing unit illustrated in FIG. 2. FIG. 5 is a diagram illustrating an example of a gray level distribution of a white image and an example of gray levels at which dynamic false contours occur when one of sub-frame patterns illustrated in FIG. 4 is used. FIG. 6 is a diagram illustrating an example of a gray level distribution of a white image and an example of gray levels at which dynamic false contours occur when another one of sub-frame patterns illustrated in FIG. 4 is used.

Referring to FIG. 2, an organic light emitting display device 200 can include a display unit 210 having a plurality of pixels PX, and a driving unit 220 configured to drive the display unit 210. The driving unit 220 may include a data driver 230, a scan driver 240 and a timing controller 250.

The display unit 210 may be coupled to the data driver 230 through a plurality of data lines, and may be coupled to the scan driver 240 through a plurality of scan lines. In some example embodiments, the driving unit 220 may further include an emission driver, and the display unit 210 may be further coupled to the emission driver through a plurality of emission control lines. The display unit 210 may include the plurality of pixels PX located at the crossing points of the plurality of data lines and the plurality of scan lines.

The driving unit 220 may drive the display unit 210 with a hybrid digital driving method. That is, the driving unit 220 may provide each pixel PX of the display unit 210 with a data voltage (e.g., a voltage for turning on a driving transistor or a voltage for turning off a driving transistor) that allows a driving transistor of the pixel PX to operate in a saturated region. The driving unit 220 may produce a grayscale by adjusting the time duration for which the pixel PX emits light in each frame. Unlike a conventional digital driving method in which a driving transistor of each pixel operates in a linear region, the display unit 210 may be driven with the hybrid digital driving method in which the driving transistor of each pixel PX operates in the saturated region, which increases the lifespan of the pixels PX.

Further, the driving unit 220 may receive input data, and may convert the input data into a mapped data based on a random data mapping information. The driving unit 220 may drive the display unit 210 based on the mapped data instead of the input data, and thus pixels PX of the display unit 100 may have substantially the same luminance at the same gray level.

The driving unit 220 may select one sub-frame pattern among a plurality of sub-frame patterns based on the random data mapping information, and may drive the display unit 210 based on the mapped data by using the selected sub-frame pattern. Since the driving unit 220 selects the sub-frame pattern based on the random data mapping information that is unique to the organic light emitting display device 200, the driving unit 220 uses the sub-frame pattern suitable for each organic light emitting display device 200. Accordingly, since the suitable sub-frame pattern is used for each organic light emitting display device 200, dynamic false contour may be reduced, and the image quality improves.

The data driver 230 included in the driving unit 220 may apply a data voltage to the display unit 210 through a plurality of data lines. The scan driver 240 included in the driving unit 220 may apply a scan signal to the display unit 210 through a plurality of scan lines. In some example embodiments, the driving unit 220 may further include an emission driver that applies an emission control signal to the display unit 210 through a plurality of emission control lines.

The timing controller 250 included in the driving unit 220 may control the operations of the organic light emitting display device 200. For example, the timing controller 250 may provide control signals to the data driver 230 and the scan driver 240 to control the operation of the organic light emitting display device 200. In some example embodiments, the data driver 230, the scan driver 240 and the timing controller 250 may be implemented as a single integrated circuit (IC). In other example embodiments, the data driver 230, the scan driver 240 and the timing controller 250 may be implemented as two or more ICs.

In some example embodiments, the driving unit 220 may include a random data mapping information storing unit 260 that stores the random data mapping information, a sub-frame pattern storing unit 270 that stores the plurality of sub-frame patterns, and a selection information storing unit 280 that stores sub-frame pattern selection information indicating the sub-frame pattern selected from the plurality of sub-frame patterns. In some example embodiments, the random data mapping information storing unit 260, the sub-frame pattern storing unit 270 and the selection information storing unit 280 may be located inside the timing controller 250. In other example embodiments, at least one of the random data mapping information storing unit 260, the sub-frame pattern storing unit 270 and the selection information storing unit 280 may be located outside the timing controller 250.

Luminances of the pixels PX may be measured at the maximum gray level, and the random data mapping information may be determined based on the measured luminances of the plurality of pixels PX such that the plurality of pixels PX may have substantially the same luminance when displaying a white image. The determined random data mapping information may be written into the random data mapping information storing unit 260. Differences between the measured luminances of the pixels PX and a reference pixel luminance may be calculated, and compensation ratios of the input data for the pixels PX may be determined based on the calculated luminance differences such that the plurality of pixels PX may have substantially the same luminance at the same gray level of the input data (e.g., at the maximum gray level of the input data). The random data mapping information including these compensation ratios for the pixels PX may be stored in the random data mapping information storing unit 260. The driving unit 220 may convert the input data into the mapped data based on the random data mapping information stored in the random data mapping information storing unit 260. For example, the driving unit 220 may multiply the input data for the pixels PX by the corresponding compensation ratios of the random data mapping information to convert the input data into the mapped data. Further, the driving unit 220 may drive the display unit 110 based on the mapped data instead of the input data, and thus the pixels PX of the display unit 210 may have substantially the same luminance at the same gray level of the input data.

The plurality of sub-frame patterns stored in the sub-frame pattern storing unit 270 may be different from each other in at least one of the following characteristics: the number of sub-frames, lengths of sub-frames, order of sub-frames, etc. Accordingly, the plurality of sub-frame patterns may have different gray levels at which dynamic false contours occur. That is, when different sub-frame patterns of the plurality of sub-frame patterns are used, dynamic false contours may occur at different gray levels.

The sub-frame pattern selection information stored in the selection information storing unit 280 may be generated based on a white image (or full-white image) gray level distribution determined by the random data mapping information. For example, the sub-frame pattern selection information may be generated based on a middle value or an average value of the white image gray level distribution. That is, a sub-frame pattern from the plurality of sub-frame patterns may be selected and the sub-frame pattern selection information is generated such that the selected sub-frame pattern has no gray level or has less gray level than the gray level at which dynamic false contour occurs, as observed near the middle value or the average value of the white image gray level distribution. In some example embodiments, such sub-frame pattern selection information may be generated by a predetermined external test device during manufacturing of the organic light emitting display device 200, and may be written into the selection information storing unit 280. Subsequently, the driving unit 210 may display an image by using the sub-frame pattern indicated by the sub-frame pattern selection information, which results in the reduction of dynamic false contours at the displayed image (in particular, when displaying a white image).

A method of operating an organic light emitting display device according to example embodiments will be described below with reference to FIGS. 2 through 6.

Referring to FIGS. 2 and 3, a plurality of sub-frame patterns that are different from each other may be stored in a sub-frame pattern storing unit 270 (S310). The plurality of sub-frame patterns stored in the sub-frame pattern storing unit 270 may be different from each other in at least one of the following characteristics: the number of sub-frames, lengths of sub-frames, order of sub-frames, etc.

For example, as illustrated in FIG. 4, although first and second sub-frame patterns PATTERN1 and PATTERN2 have the same number of sub-frames SF1, SF2, SF3, SF4, SF5, SF6, SF7, SF8, SF9, SF10, SF11 and SF12, the first and second sub-frame patterns PATTERN1 and PATTERN2 may be different from each other in lengths of the sub-frames SF1, SF2, SF3, SF4, SF5, SF6, SF7, SF8, SF9, SF10, SF11 and SF12. For example, the first through twelfth sub-frames SF1, SF2, SF3, SF4, SF5, SF6, SF7, SF8, SF9, SF10, SF11 and SF12 included in the first sub-frame pattern PATTERN1 may have lengths corresponding to values of 1, 2, 4, 7, 12, 20, 32, 48, 66, 90, 102 and 127, while the first through twelfth sub-frames SF1, SF2, SF3, SF4, SF5, SF6, SF7, SF8, SF9, SF10, SF11 and SF12 included in the second sub-frame pattern PATTERN2 may have lengths corresponding to values of 1, 2, 4, 7, 15, 24, 32, 40, 66, 91, 104 and 125. Accordingly, the first and second sub-frame patterns PATTERN1 and PATTERN2 may have different gray levels at which dynamic false contours occur.

Luminances of a plurality of pixels PX may be measured (S320) when an organic light emitting display device 200 displays a white image (or a full-white image) without random data mapping Alternatively, luminances of the plurality of pixels PX may be measured (S320) at the maximum gray level that is not adjusted by random data mapping. Random data mapping information may be generated based on the measured luminances of the plurality of pixels PX at the maximum gray level, and the random data mapping information may be stored in a random data mapping information storing unit 260 included in the organic light emitting display device 200 (S330). Since input data is converted into mapped data based on the random data mapping information, the pixels PX of a display unit 210 may have substantially the same luminance at the same gray level of the input data.

One sub-frame pattern that is suitable for each organic light emitting display device 200 may be selected from the plurality of sub-frame patterns based on the random data mapping information. Sub-frame pattern selection information indicating the selected sub-frame pattern may be stored in a selection information storing unit 280 included in the organic light emitting display device 200 (S340). The sub-frame pattern suitable for the organic light emitting display device 200 may be selected based on the random data mapping information, or in particular, based on a white image (or full-white image) gray level distribution according to the random data mapping information. For example, a sub-frame pattern from the plurality of sub-frame patterns may be selected such that the selected sub-frame pattern has no gray level or less gray level than the gray level at which dynamic false contour occurs, as observed near a middle value or an average value of the white image gray level distribution according to the random data mapping information.

For example, as illustrated in FIG. 5, the first sub-frame pattern PATTERN1 illustrated in FIG. 4 may have gray levels at which dynamic false contours DFC occur within a predetermined range MR having the middle value MV of the white image gray level distribution 400 at the center. However, as illustrated in FIG. 6, the second sub-frame pattern PATTERN2 illustrated in FIG. 4 may not have gray levels at which dynamic false contours DFC occur within the predetermined range MR having the middle value MV of the white image gray level distribution 400 at the center. In this case, the second sub-frame pattern PATTERN2 that does not have gray levels at which dynamic false contours DFC occur within the predetermined range MR may be selected from the plurality of sub-frame patterns PATTERN1 and PATTERN2, and the sub-frame pattern selection information indicating the second sub-frame pattern PATTERN2 may be stored in the selection information storing unit 280 included in the organic light emitting display device 200.

In some example embodiments, storing the plurality of sub-frame patterns, storing the random data mapping information, and storing the sub-frame pattern selection information may be performed before the normal operation of the organic light emitting display device 200, for example, when the organic light emitting display device 200 is manufactured. Further, in some example embodiments, the plurality of sub-frame patterns, the random data mapping information, and the sub-frame pattern selection information may be generated by a predetermined external device, for example, an external test device, and may be written into the organic light emitting display device 200.

While the organic light emitting display device 200 operates, a timing controller 250 may receive input data (S350), and may convert the input data into mapped data based on the random data mapping information stored in the random data mapping information storing unit 260 (S360). The organic light emitting display device 200 may display an image based on the mapped data by using the sub-frame pattern indicated by the sub-frame pattern selection information stored in the selection information storing unit 280 (S370). Thus, a driving unit 220 may drive the display unit 210 to represent gray levels indicated by the mapped data instead of the input data such that the pixels PX may have substantially the same luminance at the same gray level of the input data. Further, to allow each pixel PX to represent the gray level indicated by the mapped data, the driving unit 220 may drive the display unit 210 such that each pixel PX selectively emits or does not emit light during the sub-frames included in the selected sub-frame pattern.

As described above, in the method of operating the organic light emitting display device 200 according to example embodiments, the organic light emitting display device 200 may select a sub-frame pattern among a plurality of sub-frame patterns based on the random data mapping information that is unique to the organic light emitting display device 200. Thus each organic light emitting display device 200 may use the sub-frame pattern that is suitable for that organic light emitting display device 200. Accordingly, since the suitable sub-frame pattern is used for each organic light emitting display device 200, dynamic false contour may be reduced, and the image quality improves.

Figure 7:
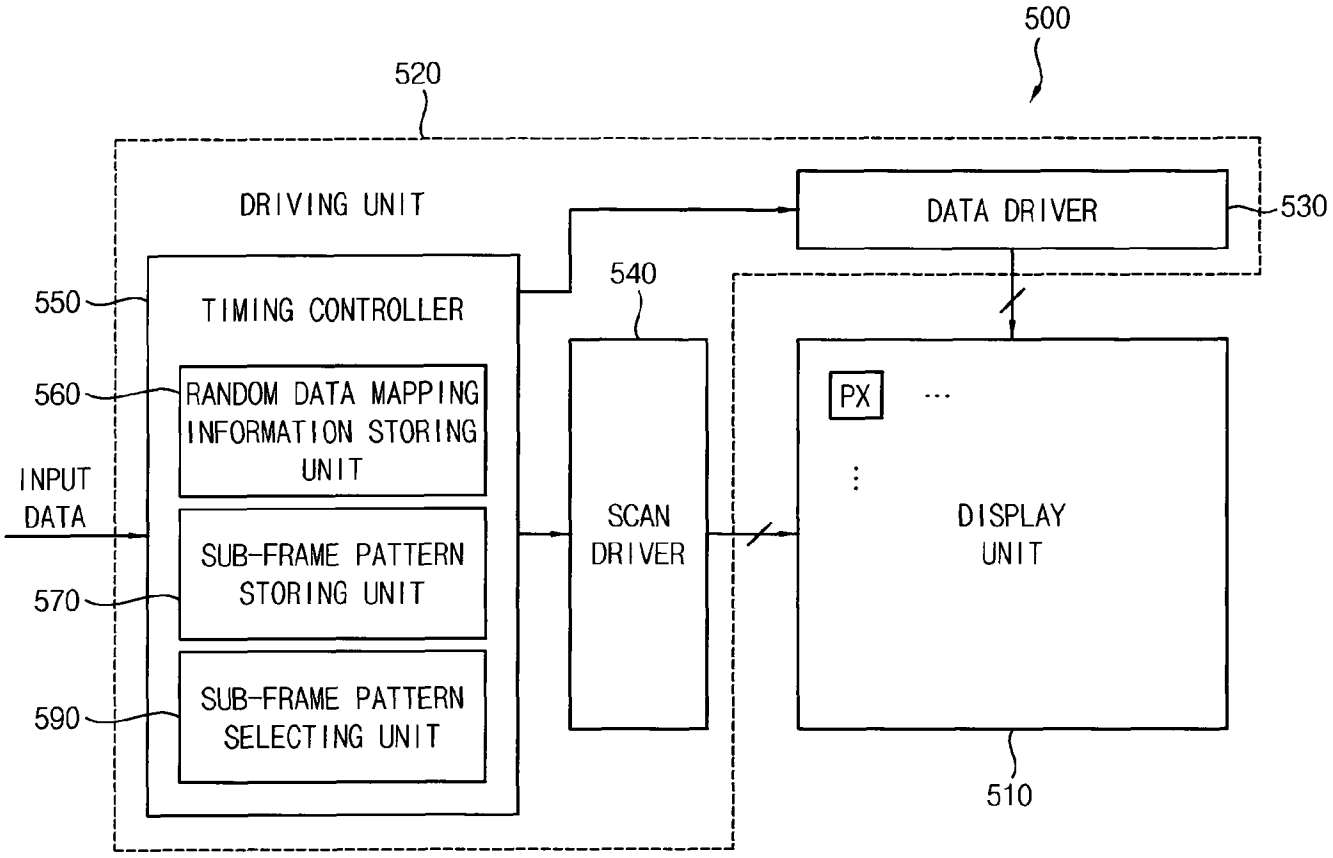
FIG. 7 is a block diagram illustrating an organic light emitting display device in accordance with example embodiments.
Figure 8:
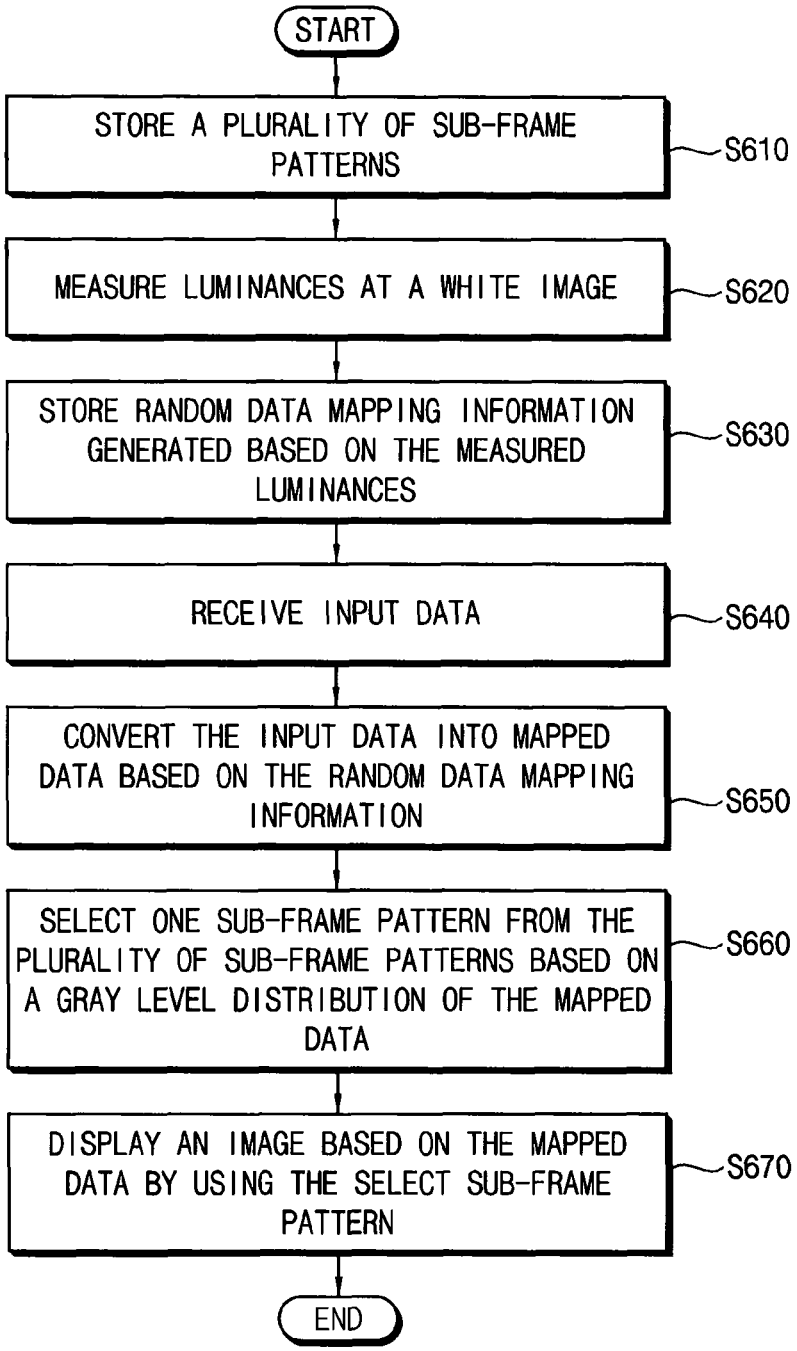
FIG. 8 is a flowchart illustrating a method of operating an organic light emitting display device in accordance with example embodiments.

FIG. 7 is a block diagram illustrating an organic light emitting display device in accordance with example embodiments, and FIG. 8 is a diagram illustrating a method of operating an organic light emitting display device in accordance with example embodiments.

Referring to FIG. 7, an organic light emitting display device 500 includes a display unit 510 having a plurality of pixels PX, and a driving unit 520 that drives the display unit 510.

The display unit 510 may include a plurality of pixels PX. The driving unit 520 may drive the display unit 510 with a hybrid digital driving method. The driving unit 520 may include a data driver 530 that applies data voltages to the display unit 510, a scan driver 240 that applies scan signals to the display unit 510, and a timing controller 550 that controls the operations of the organic light emitting display device 500.

The driving unit 520 may further include a random data mapping information storing unit 560 that stores the random data mapping information. The driving unit 520 may receive input data, and may convert the input data into mapped data based on the random data mapping information stored in the random data mapping information storing unit 560. Since the driving unit 520 drives the display unit 510 based on the mapped data instead of the input data, pixels PX of the display unit 510 may have substantially the same luminance at the same gray level of the input data.

The driving unit 520 may further include a sub-frame pattern storing unit 570 that stores a plurality of sub-frame patterns, and a sub-frame pattern selecting unit 590 that selects one sub-frame pattern from the plurality of sub-frame patterns stored in the sub-frame pattern storing unit 570. The plurality of sub-frame patterns stored in the sub-frame pattern storing unit 570 may have different gray levels at which dynamic false contours occur. The sub-frame pattern selecting unit 590 may identify a gray level distribution of the mapped data. The mapped data may be generated by adjusting the input data based on random data mapping information. The sub-frame pattern selecting unit 590 may select the one sub-frame pattern from the plurality of sub-frame patterns based on the gray level distribution of the mapped data. For example, the sub-frame pattern selecting unit 590 may calculate a middle value or an average value of the gray level distribution of the mapped data, and select the sub-frame pattern that has no gray level or has less gray level than the gray level at which dynamic false contour occurs, as observed near the middle value or the average value of the gray level distribution of the mapped data. In some example embodiments, the sub-frame pattern selecting unit 590 may select a sub-frame pattern from the plurality of sub-frame patterns at each frame, and the driving unit 520 may drive the display unit 510 by using the sub-frame pattern that is selected at each frame.

As described above, the driving unit 520 may select the one sub-frame pattern from the plurality of sub-frame patterns based on the mapped data generated by the random data mapping information at each frame, which results in the reduction of dynamic false contour and improvement of image quality.

A method of operating an organic light emitting display device according to example embodiments will be described below with reference to FIGS. 7 and 8.

Referring to FIGS. 7 and 8, a plurality of sub-frame patterns that are different from each other may be stored in a sub-frame pattern storing unit 570 (S610). The plurality of sub-frame patterns stored in the sub-frame pattern storing unit 570 may be different from each other in at least one of the following characteristics: number of sub-frames, lengths of sub-frames, order of sub-frames, etc.

Luminances of a plurality of pixels PX may be measured (S620) when an organic light emitting display device 500 displays a white image (or a full-white image) without random data mapping. Alternatively, luminances of the plurality of pixels PX may be measured (S620) at the maximum gray level that is not adjusted by random data mapping. Random data mapping information may be generated based on the measured luminances of the plurality of pixels PX at the maximum gray level, and the random data mapping information may be stored in a random data mapping information storing unit 560 included in the organic light emitting display device 500 (6330). Since input data is converted into mapped data based on the random data mapping information, the pixels PX of a display unit 510 may have substantially the same luminance at the same gray level of the input data.

While the organic light emitting display device 500 operates, a timing controller 550 may receive input data (S640), and may convert the input data into mapped data based on the random data mapping information stored in the random data mapping information storing unit 560 (S650).

A sub-frame pattern selecting unit 590 may identify a gray level distribution of the mapped data, and may select a sub-frame pattern from the plurality of sub-frame patterns based on the gray level distribution of the mapped data (S660). For example, the sub-frame pattern selecting unit 590 may calculate a middle value or an average value of the gray level distribution of the mapped data, and select the sub-frame pattern that has no gray level or has less gray level than the gray level at which dynamic false contour occurs, as observed near the middle value or the average value of the gray level distribution of the mapped data. In some example embodiments, the sub-frame pattern selecting unit 590 may select a sub-frame pattern from the plurality of sub-frame patterns at each frame.

The organic light emitting display device 500 may display an image based on the mapped data by using the sub-frame pattern selected by the sub-frame pattern selecting unit 590 (S670). Thus, the driving unit 520 may drive the display unit 510 to represent gray levels indicated by the mapped data instead of the input data such that the pixels PX may have substantially the same luminance at the same gray level of the input data. Further, to allow each pixel PX to represent the gray level indicated by the mapped data, the driving unit 520 may drive the display unit 510 such that each pixel PX selectively emits or does not emit light during the sub-frames included in the selected sub-frame pattern.

As described above, in the method of operating the organic light emitting display device 500 according to example embodiments, the organic light emitting display device 500 may select a sub-frame pattern among a plurality of sub-frame patterns based on the mapped data generated by the random data mapping information that is unique to the organic light emitting display device 500, which results in the reduction of dynamic false contour and improvement of image quality.

Figure 9:
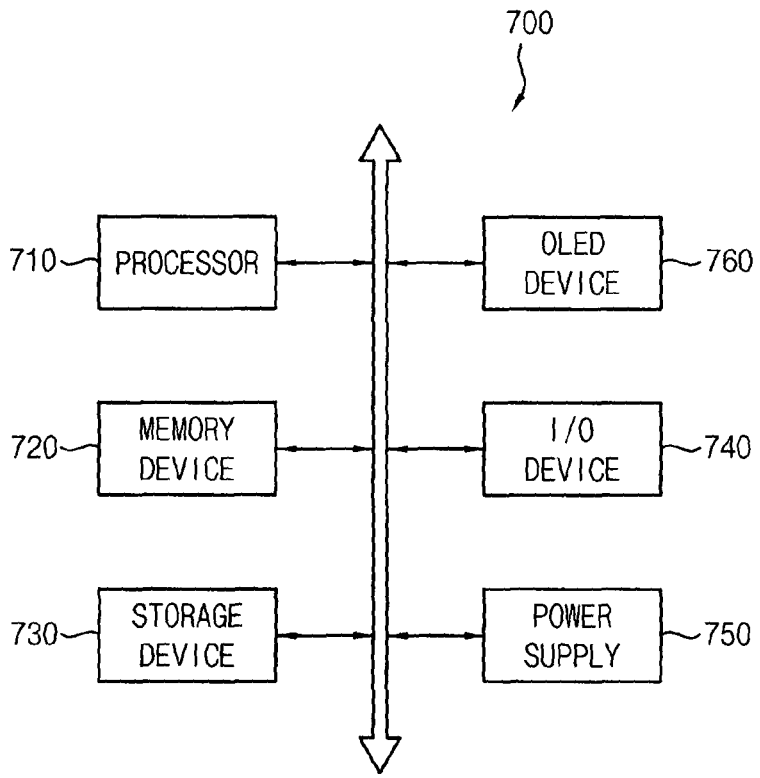
FIG. 9 is a block diagram illustrating an electronic system including an organic light emitting display device in accordance with example embodiments.

FIG. 9 is a block diagram illustrating an electronic system including an organic light emitting display device in accordance with example embodiments.

Referring to FIG. 9, an electronic system 700 includes a processor 710, a memory device 720, a storage device 730, an input/output (I/O) device 740, a power supply 750, and an organic light emitting display device 760. The electronic system 700 may further include a plurality of ports for communicating a video card, a sound card, a memory card, a universal serial bus (USB) device, or other electronic systems.

The processor 710 may perform various computing functions or tasks. The processor 710 may be for example, a microprocessor, a central processing unit (CPU), etc. The processor 710 may be connected to other components via an address bus, a control bus, a data bus, etc. Further, the processor 710 may be coupled to an extended bus such as a peripheral component interconnection (PCI) bus.

The memory device 720 may store data for operations of the electronic system 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operations of the electronic system 700. The organic light emitting display device 760 may communicate with other components via the buses or other communication links.

The organic light emitting display device 760 may use a sub-frame pattern suitable for that organic light emitting display device 760, thereby improving the image quality. In particular, the organic light emitting display device 760 may select a sub-frame pattern based on random data mapping information, thereby reducing dynamic false contour.

The present embodiments may be applied to any electronic system 700 having the organic light emitting display device 760. For example, the present embodiments may be applied to the electronic system 700, such as a television, a computer monitor, a laptop, a digital camera, a cellular phone, a smart phone, a personal digital assistant (PDA), a portable multimedia player (PMP), a MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A method of operating an organic light emitting display device comprising:

receiving input data;

converting the input data into mapped data based on random data mapping information;

selecting one sub-frame pattern from a plurality of sub-frame patterns based on the random data mapping information; and forming an image for the display device based on the mapped data and the selected sub-frame pattern.

2. The method of claim 1, wherein the plurality of sub-frame patterns have different gray levels at which dynamic false contours occur.

3. The method of claim 1, wherein luminances of a plurality of pixels included in the organic light emitting display device are measured at a maximum gray level, and the random data mapping information is generated based on the measured luminances of the plurality of pixels such that the plurality of pixels have substantially a same luminance when displaying a white image.

4. The method of claim 1, wherein the sub-frame pattern is selected according to sub-frame pattern selection information stored in the organic light emitting display device.

5. The method of claim 4, wherein the sub-frame pattern selection information is generated based on a white image gray level distribution determined by the random data mapping information.

6. The method of claim 5, wherein the sub-frame pattern selection information is generated based on a middle value or an average value of the white image gray level distribution.

7. The method of claim 1, wherein selecting the sub-frame pattern is performed at each frame.

8. The method of claim 7, wherein selecting the sub-frame pattern from the plurality of sub-frame patterns includes:

identifying a gray level distribution of the mapped data at each frame; and selecting the sub-frame pattern from the plurality of sub-frame patterns based on the gray level distribution of the mapped data.

9. The method of claim 8, wherein the sub-frame pattern is selected based on a middle value or an average value of the gray level distribution of the mapped data.

10. An organic light emitting display device, comprising:

a display unit including a plurality of pixels; and a driving unit configured to receive input data, to convert the input data into mapped data based on random data mapping information, to select one sub-frame pattern from a plurality of sub-frame patterns based on the random data mapping information, and to control the display unit to form an image for the display device based on the mapped data and the selected sub-frame pattern.

11. The organic light emitting display device of claim 10, wherein the plurality of sub-frame patterns have different gray levels at which dynamic false contours occur.

12. The organic light emitting display device of claim 10, wherein luminances of a plurality of pixels included in the organic light emitting display device are measured at a maximum gray level, and the random data mapping information is generated based on the measured luminances of the plurality of pixels such that the plurality of pixels have substantially a same luminance when displaying a white image.

13. The organic light emitting display device of claim 10, wherein the driving unit further comprises:

a random data mapping information storing unit configured to store the random data mapping information;

a sub-frame pattern storing unit configured to store the plurality of sub-frame patterns; and a selection information storing unit configured to store sub-frame pattern selection information indicating the sub-frame pattern selected from the plurality of sub-frame patterns.

14. The organic light emitting display device of claim 13, wherein the driving unit is configured to drive the display unit by using the sub-frame pattern indicated by the sub-frame pattern selection information stored in the selection information storing unit.

15. The organic light emitting display device of claim 13, wherein the sub-frame pattern selection information is generated based on a white image gray level distribution determined by the random data mapping information.

16. The organic light emitting display device of claim 15, wherein the sub-frame pattern selection information is generated based on a middle value or an average value of the white image gray level distribution.

17. The organic light emitting display device of claim 10, wherein the driving unit further comprises:

a random data mapping information storing unit configured to store the random data mapping information;

a sub-frame pattern storing unit configured to store the plurality of sub-frame patterns; and a sub-frame pattern selecting unit configured to select the sub-frame pattern from the plurality of sub-frame patterns.

18. The organic light emitting display device of claim 17, wherein the sub-frame pattern selecting unit selects the sub-frame pattern at each frame.

19. The organic light emitting display device of claim 17, wherein the sub-frame pattern selecting unit identifies a gray level distribution of the mapped data at each frame, and selects the sub-frame pattern from the plurality of sub-frame patterns based on the gray level distribution of the mapped data.

20. The organic light emitting display device of claim 19, wherein the sub-frame pattern selecting unit calculates a middle value or an average value of the gray level of the mapped data, and selects the sub-frame pattern from the plurality of sub-frame patterns based on the calculated middle value or the calculated average value.

* * * * *